United States Patent [19]

Witherspoon

[11] Patent Number: 4,567,802

[45] Date of Patent: Feb. 4, 1986

[54] MORTISE AND BEVEL CUTTER

[76] Inventor: John K. Witherspoon, Rte. 3, Box 18, Jefferson, N.C. 28640

[21] Appl. No.: 663,515

[22] Filed: Oct. 22, 1984

[51] Int. Cl.[4] ..... B26D 3/02

[52] U.S. Cl. ..... 83/581; 83/589; 83/607; 83/646; 83/648

[58] Field of Search ..... 83/581, 589, 605, 607–609, 83/646, 648, 473, 471.2

[56] References Cited

U.S. PATENT DOCUMENTS 484,984 10/1892 Wesel ..... 83/605 X 3,105,528 10/1963 Loughridge ..... 83/471.2 X

*Primary Examiner*—James M. Meister

*Attorney, Agent, or Firm*—W. Thad Adams, III

[57] ABSTRACT

A mortise and bevel cutter (10) includes a base (11) and a table (12) mounted thereon for rotation. A platform (22) is mounted for pivotal movement on table (12). A cutter assembly which includes a blade holder (40) and blade (45) is mounted on a handle (29) in a position to cut molding which is positioned on platform (22). A cut having a desired angle can be made by adjusting the position of the table (12) and the platform (22) to variable positions. A wedge (19) is mounted to move progressively under the platform (22) in order to position it securely at any desired angle.

9 Claims, 9 Drawing Figures

MORTISE AND BEVEL CUTTER

TECHNICAL FIELD AND BACKGROUND OF THE INVENTION

This invention relates to a mortise and bevel cutter which is particularly adapted for cutting automobile body side molding and similar long strips of material. For purposes of example and illustratiion, this application will refer to molding of the specific type used for providing a decorative and protective trim on the sides of automobiles and other vehicles. Ordinarily, this type of body side molding is constructed of a hard plastic or rubber material which has a flat side with a strong adhesive which is protected by a peel-off strip until the molding is ready for application to the vehicle. When applied to the vehicle, the exposed surface of the molding usually includes a textured portion and one or more decorative metallic strips.

Body side molding of the type described above is applied to automobiles during their manufacture. Subsequently, if the vehicle is wrecked or damaged and sheet metal repair or replacement required, a length of body side molding must be applied to the new body work after it has been installed, sanded and painted. Usually, the side molding extends along substantially the entire side of the vehicle. Therefore, it must be divided into sections corresponding to the breaks at each door. Depending upon the position of the molding on the side of the vehicle and the angle at which the door seam extends, a mitered and/or beveled end must be cut onto the side molding at the exact length required to match the door of body panel. Insofar as is known, prior art application of body side molding in the manner described above is usually carried out simply by estimating the amount of angle and/or bevel required and manually cutting the angle and/or bevel with a razor blade or similar implement. Unless great care is taken, the finished product does not look professionally done and, in many cases, the customer will refuse the job and require that it be redone.

SUMMARY OF THE INVENTION

Therefore, it is an object of the invention to provide a mortise and bevel cutter which permits a wide variety of mortises and/or bevels to be cut precisely with speed and safety.

It is another object of the invention to provide a mortise and bevel cutter with which a mortise and bevel can be simultaneously cut.

It is another object of the invention to provide a mortise and bevel cutter which will permit precise duplication of a mortise and/or bevel.

These and other objects of the present invention are achieved in the preferred embodiment disclosed below by providing a base having a cutter mounted thereon and including a cutter blade positioned in vertically spaced-apart relation to the base and defining a fixed cutting plane relative to the base. A table is rotatably mounted on the base beneath the cutter blade. A tiltable platform is mounted on the table for rotation and for adjustable tilting movement in a plane perpendicular to the plane of rotation of the table. The platform is adapted to support a workpiece relative to the cutter blade at an angle which is determined by the position of the workpiece on the platform, the degree of tilt of the platform relative to the table, and the position of rotation of the table relative to the base.

The cutter includes an elongate handle which is preferably biased in spaced-apart relation to the platform and workpiece.

Means are provided for adjusting and maintaining the desired tilt of the table and preferably comprises a wedge mounted for radial movement on the surface of the table to a variable position under the platform.

BRIEF DESCRIPTION OF THE DRAWINGS

Some of the objects of the invention have been set forth above. Other objects and advantages of the invention will appear as the description of the invention proceeds when taken in conjunction with the following drawings in which.

DESCRIPTION OF THE PREFERRED EMBODIMENT

Figure 1:
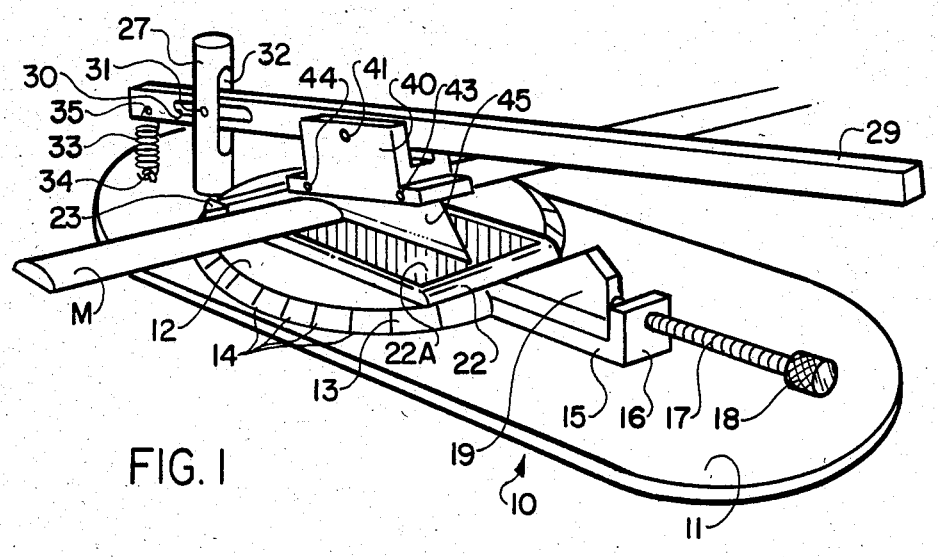
FIG. 1 is a perspective view of a mortise and bevel cutter according to the invention.
Figure 2:
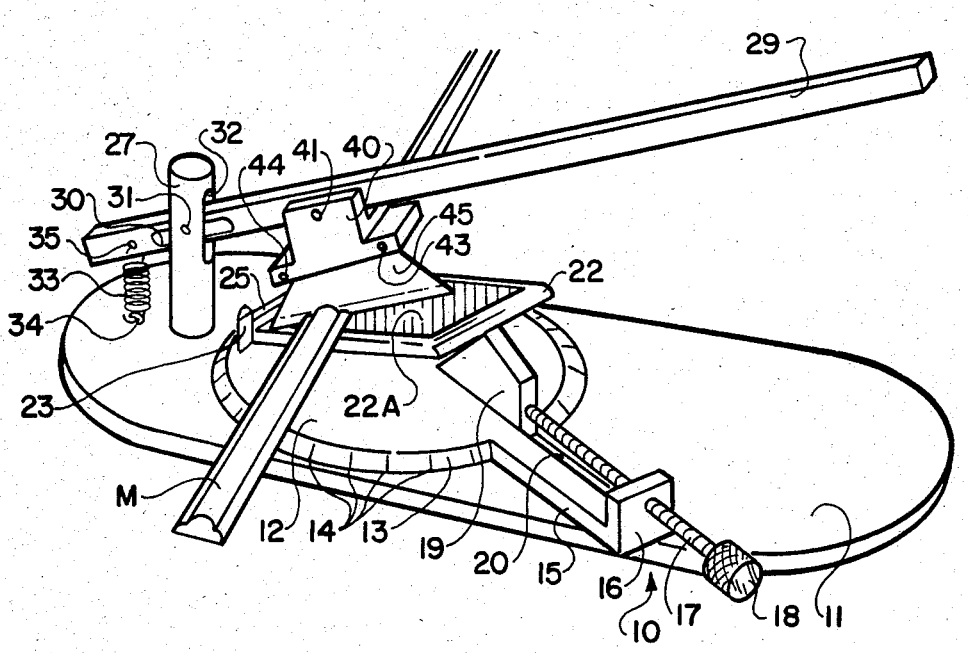
FIG. 2 is a view similar to that in FIG. 1, but showing the table and platform in a different cutting position.

Referring now specifically to the drawings, a mortise and bevel cutter according to the present invention is illustrated in FIG. 1 and generally designated by reference numeral 10. Cutter 10 includes a base 11 which is formed of a relatively thin flat plate which is elongate and curved on either end. A table 12 is mounted for rotation on base 11 by means of a hole **11*a* (see FIG. 4) in base 11 which receives a screw 12*a* which is tapped into the bottom surface of table 12. The table 12 can be rotated as desired and suitably tightened by tightening the screw. Referring again to FIG. 1, the table 12 includes a beveled peripheral edge 13 with indicia 14 represented thereon. Indicia 14 may be degrees of angle or simply marks established by trial and error indicating the proper position of the table for a particular cut. Table 12 also includes an arm 15 having an upright member 16 on its outwardly extending, free end, through which is treated an adjustment screw 17. Screw 17 has a knurled handle 18 on one end and a wedge 19 mounted on its other end. Referring now to FIG. 2, wedge 19 is positioned in a channel 20 cut into arm 15. Wedge 19 is positioned in channel 20 and screw 17 is tapped into wedge 19 so it does not turn with screw 17**.

Figure 4:
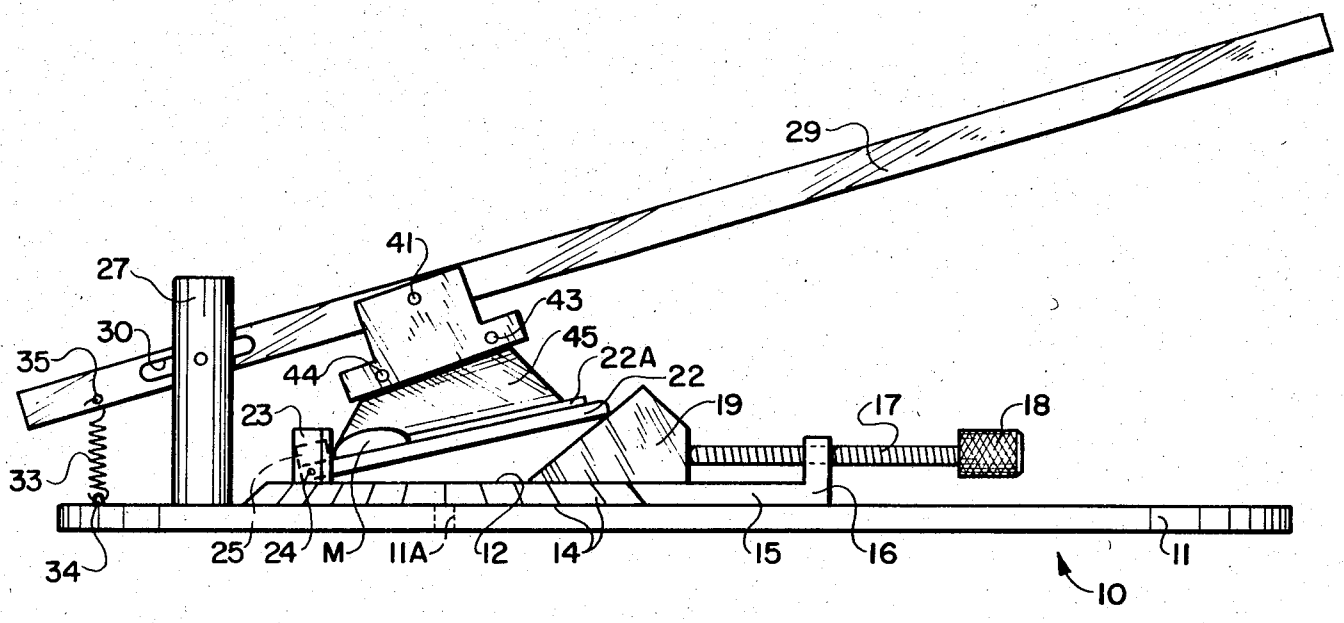
FIG. 4 is a side elevational view of the mortise and bevel cutter in yet another cutting position.

Referring now to FIG. 4, a platform 22 is mounted for tilting movement on table 12 by means of spaced-apart, upright posts **23*a*, 23*b* and shaft 24. Platform 22 pivots upwardly and around the axis defined by shaft 24. Preferably, a covering 22*a* of plastic, rubber or cork prevents molding from slipping on the platform 22 and also provides a cushioned surface against which the blade, described below, can wear without damage. A support 25 is mounted on platform 22 and provides an elongate surface against which the molding can be supported while being cut. Still referring to FIG. 4, an upright post 27 is mounted near one end of base 11. Positioned for pivotal and sliding movement to post 27 is a cutter handle 29. Handle 29 includes an elongate slot 30 through which is positioned a pin 31 carried by post 27. Handle 29 extends through a vertically extending slot 32 in post 27. Handle 29 is biased in an upwardly position away from platform 22 and table 12 by means of a spring 33, one end of which is attached to base 11 by a hook 34 and the other end of which is attached to handle 29 through a suitably positioned hole 35**.

Referring now to FIG. 2, the molding is cut by means of a cutter assembly which includes a blade holder 40. Blade holder 40 is given pivotal limited movement by means of a pin 41 to handle 29. Set screws 43 and 44 communicate with a slot (not shown) in the bottom of blade holder 40 which permit a razor blade 45 to be securely held for cutting.

Now that the basic structure of cutter 10 has been described, its operation will now be explained.

Referring again to FIG. 1, a length of automobile body side molding is shown in position on table 22. In the position shown in FIG. 1, the blade 45 will make a straight, perpendicular cut, such as that shown in FIG. 8.

Figure 3:
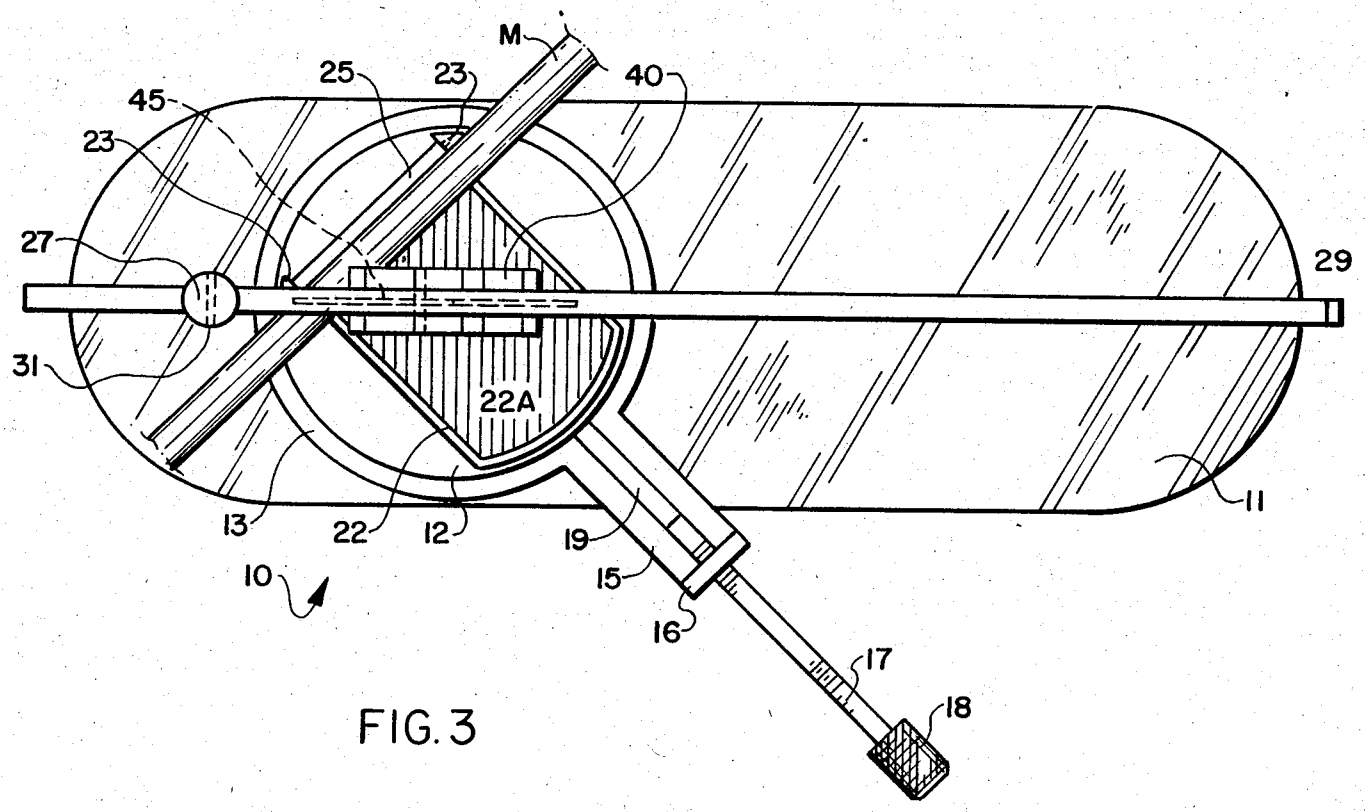
FIG. 3 is a top plan view of the mortise and bevel cutter according to the invention.
Figures 6, 7, 8, 9:
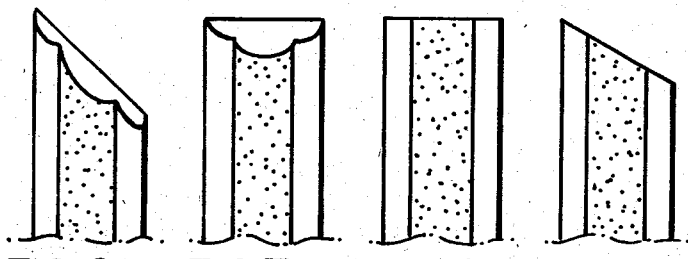
FIG. 6 shows a section of molding cut with the cutter in the position shown in FIG. 2.
FIG. 7 shows a section of molding cut with the cutter in the position shown in FIG. 5.
FIG. 8 shows a section of molding cut with the cutter in the position shown in FIGS. 1 or 4.
FIG. 9 shows a section of molding cut with the cutter in the position shown in FIG. 3.

Referring to FIG. 3, a cut such as shown in FIG. 9 can be made by rotating table 12 to its desired position while keeping the platform 22 in its fully lowered position so that its surface is parallel with the top surface of platform 22.

Figure 5:
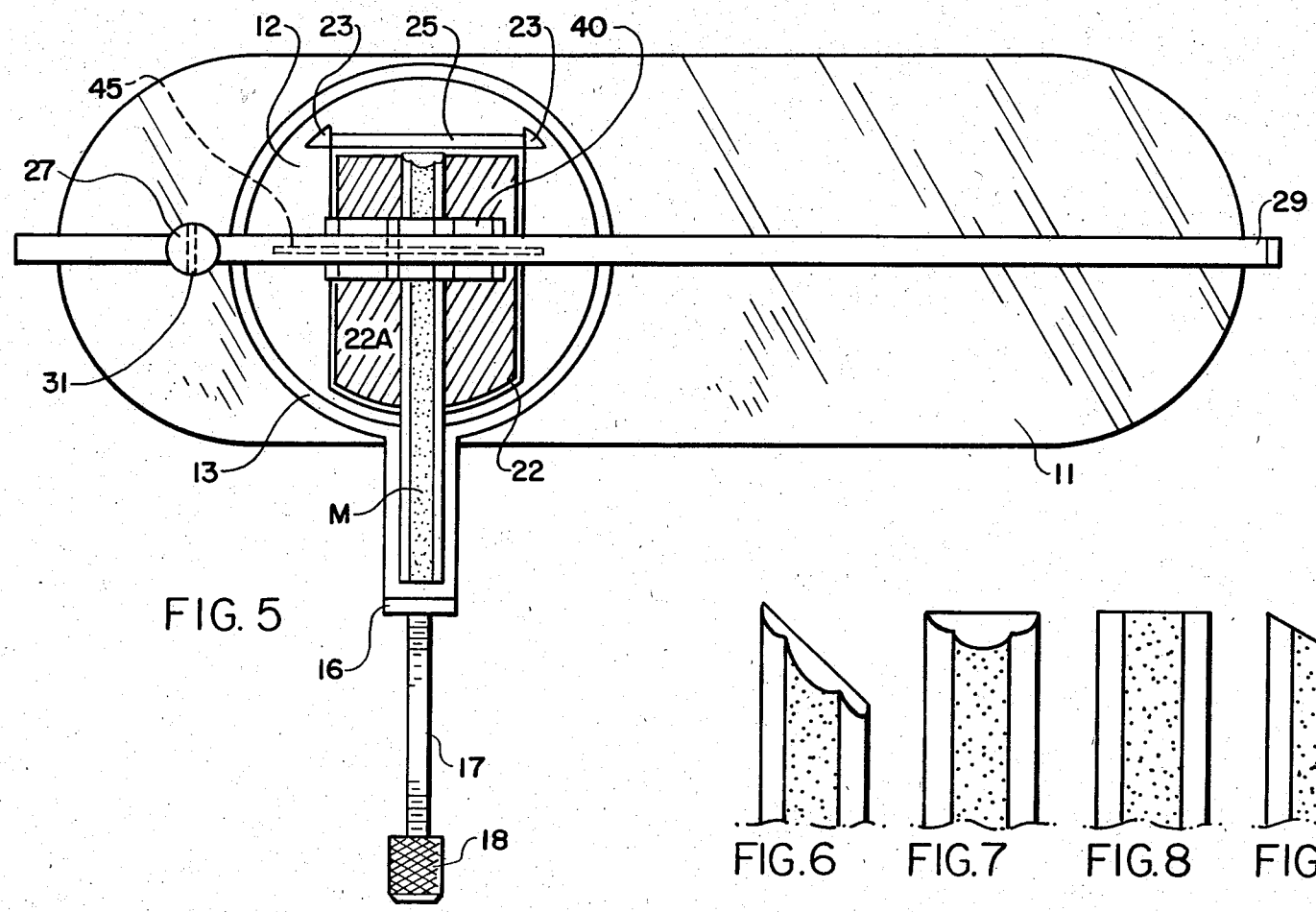
FIG. 5 is a top plan view of the mortise and bevel cutter with the table perpendicular to the cutter blade.

To make a bevel cut such as is shown in FIG. 7, table 12 is rotated 90degrees to the angle of blade 45. The tiltable platform 22 is raised by turning screw 17, causing wedge 19 to move progressively down channel 20 towards the center of platform 22. As wedge 19 moves under platform 22, it rises into the desired position. As is shown in FIG. 5, the molding is positioned perpendicular to the blade 45 and the cut is made by depressing handle 29. Cutter 10 can also be used to make combination mortise and bevel cuts, such as shown in FIG. 6. As is shown in FIG. 2, table 12 has been rotated to a desired position and the molding has been placed on platform 22. A number of different arrangements can accomplish the same result. For example the molding can be placed against the supports 25 if desired, or, as is shown in FIG. 2, can be positioned to allow more clearance for blade 45. The combination of the raised platform 22 and the rotated table permits the mortise cut and the bevel cut to be simultaneously made. Of course, a certain amount of experimentation may be desired to find the best position for making a particular cut. Once this position is found, suitable markings can be made on the table 12 or the surface of platform 22 to enable the same cut to be precisely duplicated over and over.

Although not shown in the drawings, much wider widths of molding can be cut. It has been determined that the cuts are best made if the molding is positioned somewhere near or slightly forward of the centerpoint of blade 45. Therefore, to facilitate easy cutting, the handle 29 and, consequently, blade 45 can be moved laterally with reference to the molding by sliding the handle 29 forwardly or rearwardly to the extent permitted by the length of slot 30.

Also, as is evident from the drawings, automobile body moldings have different shapes and cross sections. Cutting these various shapes is facilitated by permitting the blade assembly 40 to pivot slightly as has been previously described. Again, my moving the handle 29 laterally, the precise position of blade 45 relative to the molding can be achieved to facilitate a quick and accurate cut.

One particular embodiment of the invention is described above. While not illustrated, another suitable design of the invention would be achieved by mounting the tiltable platform 22 directly on base 12 and rotatably mounting table 12 on the platform. This construction also permits the movement of the molding relative to the blade 45 necessary to make a wide variety of cuts.

A cutter 10 is described above. Various details of the invention may be changed without departing from its scope. Furthermore, the foregoing description of the preferred embodiment of the cutter according to the present invention is provided for the purpose of illustration only and not for the purpose of limitation— the invention being defined by the claims.

I claim:

1. A mortise and bevel cutter for cutting automobile body side molding and similar workpieces, comprising:

a. a base;

b. a cutter means mounted on said base and including a cutter blade positioned in vertically spaced-apart relation to said base and defining a fixed cutting plane relative to said base;

c. a table rotatably mounted on said base beneath said cutter blade;

d. a tiltable platform mounted on said table for rotation therewith and for adjustable tilting movement in a plane perpendicular to the plane of rotation of said table;

e. said platform adapted to support on its surface a workpiece at a position relative to said cutter blade determined by the position of the workpiece on said platform, the degree of tilt of said platform relative to said table, and the position of rotation of said table relative to said base; and f. said cutter being adapted for movement into and out of engagement with said platform for severing the workpiece at the desired angle and/or bevel.

2. A mortise and bevel cutter according to claim 1, wherein said cutter means comprises:

a. an upright post;

b. an elongate handle pivotally mounted on said post; and c. said cutter blade carried by said handle in such position as to cut the workpiece at the desired angle and/or bevel when said handle and the blade carried thereby is moved towards the workpiece.

3. A mortise and bevel cutter according to claim 2 and including biasing means for normally biasing said cutter blade in spaced-apart relation to said platform and said workpiece.

4. A mortise and bevel cutter according to claim 1 and including means for adjusting and maintaining the desired tilt of said table and comprising a wedge mounted for radial movement on the surface of said table to a predetermined position under said platform.

5. A mortise and bevel cutter according to claim 1 and including means for adjusting and maintaining the desired position of tilt of said table and comprising:

a. a wedge mounted for radial movement on said table to a predetermined position under said platform; and b. an elongate screw carried said table and engaging said wedge, whereby turning of said screw incrementally moves said wedge into or out of position under said platform.

6. A mortise and bevel cutter according to claim 1, wherein said blade is pivotally mounted on said handle to permit engagement of the blade edge with the workpiece in subsantial alignment with the surface of the platform within a given range of tilt thereof.

7. A mortise and bevel cutter according to claim 2, wherein said upright post includes a pin and said handle is provided with an elongate slot with said pin slidably positioned therein whereby the blade is moveable relative to the position of the workpiece on the platform to permit adjustment of the blade when cutting a workpiece wider than the effective cutting length of the blade and to permit the workpiece to be placed at various positions on said table.

8. A mortise and bevel cutter according to claim 1 and including a support carried by said platform for supporting the molding in a fixed position while being cut.

9. A mortise and bevel cutter for cutting automobile body side molding and similar workpieces, comprising:

a. a base;

b. cutter means mounted on said base and including a cutter blade positioned in vertically spaced-apart relation to said base and defining a fixed cutting plane relative to said base;

c. a table mounted under said cutter blade for rotational movement relative thereto;

d. a tiltable platform mounted for adjustable tilting movement in a plane perpendicular to the plane of rotation of said table; one of either said table or said platform being mounted on said base and the other of said table or said platform being mounted on said one said table or platform:

e. said platform adapted to support on its surface a workpiece at a position relative to said cutter blade determined by the position of the workpiece on said platform, the degree of tilt of said platform relative to said table, and the position of rotation of said table relative to said base; and f. said cutter blade being adapted for movement into and out of engagement with said platform for severing the workpiece at the desired angle and/or bevel.

* * * * *